US011282434B1

(12) United States Patent
Chan et al.

(10) Patent No.: US 11,282,434 B1
(45) Date of Patent: Mar. 22, 2022

(54) DRIVING METHOD FOR ACTIVE MATRIX DISPLAY

(71) Applicant: Solomon Systech (China) Limited, Nanjing (CN)

(72) Inventors: Wing Chi Stephen Chan, Hong Kong (HK); Chi Wai Lee, Hong Kong (HK); Chui Kwan Leung, Hong Kong (HK)

(73) Assignee: Solomon Systech (China) Limited, Nanjing (CN)

( * ) Notice: Subject to any disclaimer, the term of this patent is extended or adjusted under 35 U.S.C. 154(b) by 0 days.

(21) Appl. No.: 17/137,329

(22) Filed: Dec. 29, 2020

(51) Int. Cl.
*G09G 5/00* (2006.01)
*G09G 3/20* (2006.01)

(52) U.S. Cl.
CPC ... *G09G 3/2022* (2013.01); *G09G 2310/0267* (2013.01); *G09G 2310/08* (2013.01)

(58) Field of Classification Search
CPC ..... G09G 3/2022; G09G 2310/08; G09G 2310/0267
See application file for complete search history.

(56) References Cited

U.S. PATENT DOCUMENTS 6,008,793 A * 12/1999 Shigeta ..... G09G 3/2051 345/204
6,094,243 A * 7/2000 Yasunishi ..... G09G 3/3622 349/33
7,391,391 B2 * 6/2008 Ohshima ..... G09G 3/2022 345/60
7,817,170 B2 * 10/2010 Miyagawa ..... G09G 3/2029 345/690
10,347,174 B2 * 7/2019 Ng ..... G09G 5/10
2002/0015032 A1 * 2/2002 Koyama ..... G09G 3/3688 345/204
2002/0018029 A1 * 2/2002 Koyama ..... G09G 3/3275 345/39
2002/0024054 A1 * 2/2002 Koyama ..... G09G 3/3275 257/84
2002/0047852 A1 * 4/2002 Inukai ..... G09G 3/3266 345/629
2003/0063077 A1 * 4/2003 Koyama ..... G09G 3/3233 345/204
2008/0018559 A1 * 1/2008 Ochi ..... G09G 3/2077 345/59
2012/0026163 A1 * 2/2012 Koyama ..... H04N 13/324 345/419
(Continued)

*Primary Examiner* — Joe H Cheng
(74) *Attorney, Agent, or Firm* — Idea Intellectual Limited; Margaret A. Burke; Sam T. Yip

(57) ABSTRACT

A method is provided for driving an active matrix display device comprising a matrix of pixels configured to display an n-bit image data in an image frame by dividing the image frame for each pixel into n subframes; defining the n-bit image data to have n1 number of greater significant bits and n2 number of lesser significant bits, where n1+n2=n; and selecting the rows of pixels non-sequentially in the subframes corresponding to the n2 number of lesser significant bits such that there is no more than one row of pixel being selected in each subframe. The provided method can utilize the scan sequence in a more flexible way to make better use of the available scan time such that a higher display resolution or dynamic range can be achieved without increasing the scanning frequency.

19 Claims, 12 Drawing Sheets

(56) References Cited

U.S. PATENT DOCUMENTS

| | | | | |
|---|---|---|---|---|
| 2015/0029131 | A1* | 1/2015 | Cheng | G06F 3/0446 345/174 |
| 2021/0049957 | A1* | 2/2021 | Lee | G09G 3/32 |
| 2021/0118358 | A1* | 4/2021 | Lee | G09G 3/2022 |

* cited by examiner

Part 1

| scan count | scan line | Bit | RAM row |
|---|---|---|---|
| 0 | 0 | b3 | 3 |
| 1 | 1 | b3 | 7 |
| 2 | 2 | b3 | 11 |
| 3 | 3 | b3 | 15 |
| 4 | 4 | b2 | 18 |
| 5 | 5 | b2 | 22 |
| 6 | 6 | b2 | 26 |
| 7 | 7 | b2 | 30 |
| 8 | 8 | b1 | 33 |
| 9 | 9 | b1 | 37 |
| 10 | 10 | b1 | 41 |
| 11 | 11 | b1 | 45 |
| 12 | 12 | b0 | 48 |
| 13 | 13 | b0 | 52 |
| 14 | 14 | b0 | 56 |
| 15 | 15 | b0 | 60 |
| 16 | - - | | 64 |
| 17 | - - | | 64 |
| 18 | - - | | 64 |
| 19 | - - | | 64 |
| 20 | 12 | b3 | 51 |
| 21 | 13 | b3 | 55 |
| 22 | 14 | b3 | 59 |
| 23 | 15 | b3 | 63 |
| 24 | 8 | b0 | 32 |
| 25 | 9 | b0 | 36 |
| 26 | 10 | b0 | 40 |
| 27 | 11 | b0 | 44 |
| 28 | - - | | 64 |
| 29 | - - | | 64 |
| 30 | - - | | 64 |
| 31 | - - | | 64 |
| 32 | 8 | b3 | 35 |
| 33 | 9 | b3 | 39 |
| 34 | 10 | b3 | 43 |
| 35 | 11 | b3 | 47 |
| 36 | 4 | b1 | 17 |
| 37 | 5 | b1 | 21 |
| 38 | 6 | b1 | 25 |
| 39 | 7 | b1 | 29 |

Part 2

| scan count | scan line | bit | RAM row |
|---|---|---|---|
| 40 | - - | | 64 |
| 41 | - - | | 64 |
| 42 | - - | | 64 |
| 43 | - - | | 64 |
| 44 | - - | | 64 |
| 45 | - - | | 64 |
| 46 | - - | | 64 |
| 47 | - - | | 64 |
| 48 | - - | | 64 |
| 49 | - - | | 64 |
| 50 | - - | | 64 |
| 51 | - - | | 64 |
| 52 | 4 | b0 | 16 |
| 53 | 5 | b0 | 20 |
| 54 | 6 | b0 | 24 |
| 55 | 7 | b0 | 28 |
| 56 | - - | | 64 |
| 57 | - - | | 64 |
| 58 | - - | | 64 |
| 59 | - - | | 64 |
| 60 | 4 | b3 | 19 |
| 61 | 5 | b3 | 23 |
| 62 | 6 | b3 | 27 |
| 63 | 7 | b3 | 31 |
| 64 | 0 | b0 | 0 |
| 65 | 1 | b0 | 4 |
| 66 | 2 | b0 | 8 |
| 67 | 3 | b0 | 12 |
| 68 | - - | | 64 |
| 69 | - - | | 64 |
| 70 | - - | | 64 |
| 71 | - - | | 64 |
| 72 | 0 | b1 | 1 |
| 73 | 1 | b1 | 5 |
| 74 | 2 | b1 | 9 |
| 75 | 3 | b1 | 13 |
| 76 | - - | | 64 |
| 77 | - - | | 64 |
| 78 | - - | | 64 |
| 79 | - - | | 64 |

Part 3

| scan count | scan line | bit | RAM row |
|---|---|---|---|
| 80 | - - | | 64 |
| 81 | - - | | 64 |
| 82 | - - | | 64 |
| 83 | - - | | 64 |
| 84 | 12 | b2 | 50 |
| 85 | 13 | b2 | 54 |
| 86 | 14 | b2 | 58 |
| 87 | 15 | b2 | 62 |
| 88 | 0 | b2 | 2 |
| 89 | 1 | b2 | 6 |
| 90 | 2 | b2 | 10 |
| 91 | 3 | b2 | 14 |
| 92 | - - | | 64 |
| 93 | - - | | 64 |
| 94 | - - | | 64 |
| 95 | - - | | 64 |
| 96 | 8 | b2 | 34 |
| 97 | 9 | b2 | 38 |
| 98 | 10 | b2 | 42 |
| 99 | 11 | b2 | 46 |
| 100 | - - | | 64 |
| 101 | - - | | 64 |
| 102 | - - | | 64 |
| 103 | - - | | 64 |
| 104 | - - | | 64 |
| 105 | - - | | 64 |
| 106 | - - | | 64 |
| 107 | - - | | 64 |
| 108 | - - | | 64 |
| 109 | - - | | 64 |
| 110 | - - | | 64 |
| 111 | - - | | 64 |
| 112 | - - | | 64 |
| 113 | - - | | 64 |
| 114 | - - | | 64 |
| 115 | - - | | 64 |
| 116 | 12 | b1 | 49 |
| 117 | 13 | b1 | 53 |
| 118 | 14 | b1 | 57 |
| 119 | 15 | b1 | 61 |

FIG. 8

| $\Sigma T_s$ | Minimum required numbers of lesser significant bits (n2_min) | Lesser significant bits |
|---|---|---|
| $\leq 1.3*T_h(0)$ | 3 | b0, b1, b2 |
| $\leq 2.2*T_h(0)$ | 4 | b0, b1, b2, b3 |
| $\leq 3.6*T_h(0)$ | 5 | b0, b1, b2, b3, b4 |

DRIVING METHOD FOR ACTIVE MATRIX DISPLAY

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention is generally related to active matrix display devices. More particularly, the present invention is related to active matrix display devices based on digital driving signals.

BACKGROUND

Active matrix has been a promising addressing technology for flat panel display devices such as liquid crystal display (LCD), organic light emitting diode (OLED) displays, mini LED displays and micro LED (uLED) displays. In general, an active matrix display includes pixels and each pixel includes a driver circuit comprising switching elements such as transistors and storage elements such as capacitor for actively addressing the pixel and maintaining the pixel state. Typically, the pixels are selected row by row by a gate driver through a plurality of scan lines and then each pixel at the selected row is controlled by a source driver through a corresponding data line to emit light for displaying an image.

Active matrix display devices may be driven with analog or digital driving signals. In the analogy approach, brightness of a pixel is controlled with analog signals such as voltage or current levels of the driving signal, whereas in the digital approach, brightness of a pixel is controlled with pulse width of the driving signal. The digital approach has been gaining popularity over the analogy approach as it can use digital video signals directly for pixel driving therefore requires relatively simple driver circuits and has less power consumption. It has also better luminance uniformity because the display quality is less sensitive to variances in current-voltage characteristics of the transistors in pixel driver circuits.

In the digital modulation approach, image frame for each pixel is divided into a number of sub-frames each corresponds to a bit in the digital image data to be displayed. The subframes may have different durations which are weighted according to positions of bits to be represented respectively and under a rule that the more significant bit the subframe represents the longer the subframe duration is.

For each sub-frame, each row of pixels is scanned for a scan time. Pixels of the scanned row are then controlled to emits at a fixed luminance (turned ON) or zero luminance (turned OFF) to represent a logical value of "1" or "0" respectively and hold the state over the subframe duration. As such, a gray level scale of 2n levels can be achieved by means of aggregation of a hold time over which the pixel is turned ON within each frame.

Conventionally, the scan lines are scanned sequentially in each subframes and the sub-frames are arranged sequentially in an ascending/descending order and repeated cyclically. However, in order to accomplish high display resolution or dynamic range, the scanning speed may not high enough such that the scanning cannot be completed before start of next frame. If the scan time of the present frame is longer than the period of a last subframe and overruns into the first subframe of the next frame, there are two scan lines in operation concurrently over the first subframe of the next frame.

SUMMARY OF THE INVENTION

One objective of the present invention is to provide a driving method to address the afore-said issue by utilizing the scan sequence in a more flexible way to make better use of the available scan time such that a higher display resolution or dynamic range can be achieved without increasing the scanning frequency.

According to one aspect of the present invention, a method for driving an active matrix display device comprising a matrix of pixels organized in Nr number of rows and Nc number of columns, each pixel being configured to display an n-bit image data in an image frame; the method comprising: dividing the image frame for each pixel into n subframes, SFi, each corresponds to a bit bi in the image data to be displayed by the pixel, where i=0, 1, . . . , n−1, and having a subframe duration being weighted according to a position of the corresponding bit bi in the image data; dividing each subframe into a scan time and a hold time occurring after the scan time; selecting each row of pixels for each subframe by applying a scanning signal to a scan line connected to the row of pixels over the scan time; driving each pixel of the row selected in each subframe to emit a luminance by applying a data signal to a data line connected to the pixel and holding the luminance over the hold time; wherein the emitted luminance represents a logic value of a corresponding bit in the image data to be displayed by the pixel. Preferably, the method further comprises: defining the n-bit image data to have n1 number of greater significant bits and n2 number of lesser significant bits, where n1+n2=n; and selecting the rows of pixels non-sequentially in the subframes corresponding to the n2 number of lesser significant bits such that there is no more than one row of pixel being selected in each subframe.

BRIEF DESCRIPTION OF THE DRAWINGS

Embodiments of the invention are described in more details hereinafter with reference to the drawings, in which:

FIG. 5 shows an embodiment wherein the rows of pixels are grouped; FIG. 6 depicts an embodiment wherein the rows of pixels are consecutively grouped; and FIG. 7 depicts an embodiment wherein the rows of pixels are alternately grouped;

FIG. 8 shows an exemplary look-up table storing a prescribed sequence of scanning for the subframes corresponding to the lesser significant bits according to one embodiment of the present invention;

DETAILED DESCRIPTION OF THE INVENTION

In the following description, methods for driving an active matrix display and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
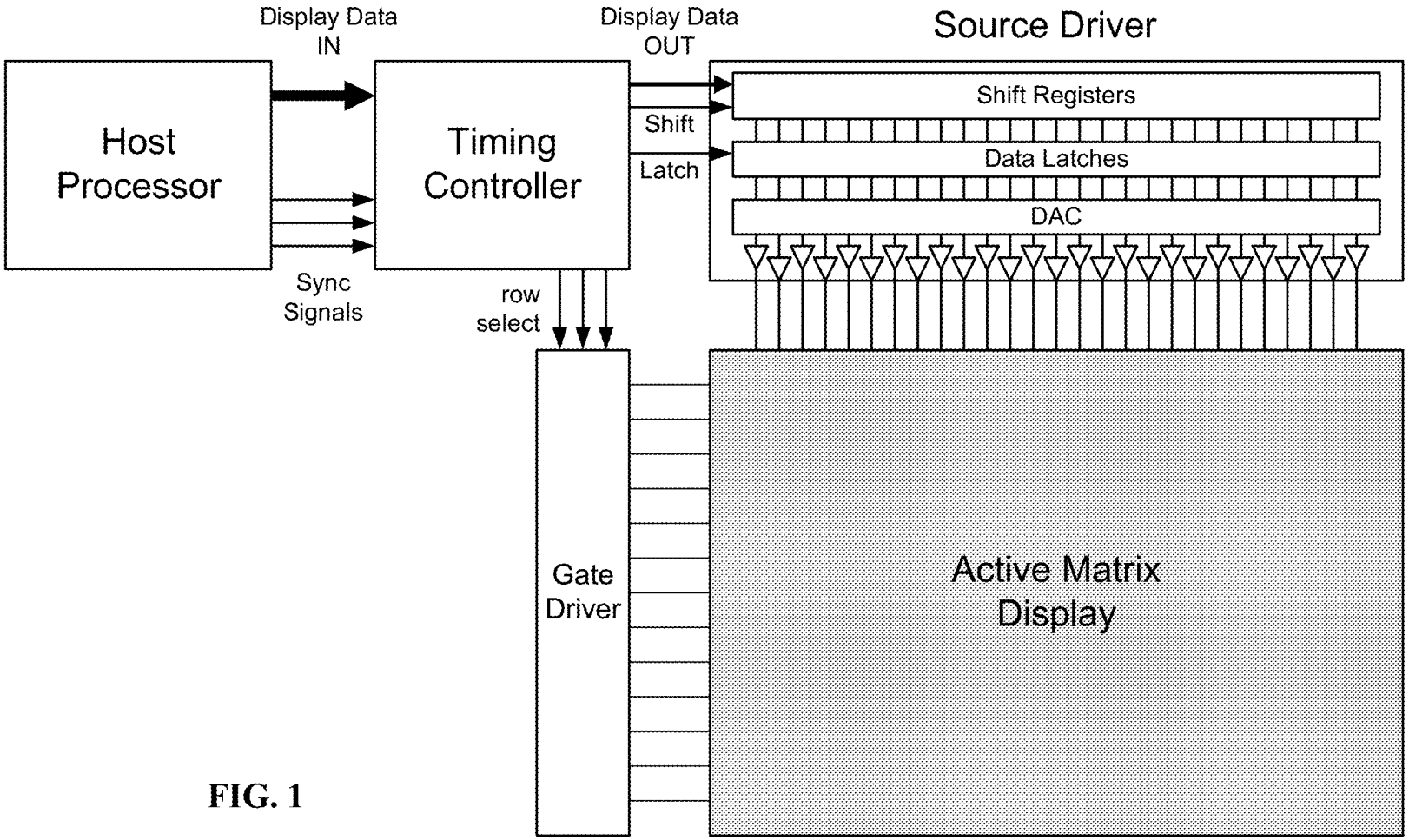
FIG. 1 shows a simplified system block diagram of an active matrix display device according to an embodiment of the present invention.

FIG. 1 shows a simplified system block diagram of an active matrix display device. Referring to FIG. 1. the display panel may include a host processor; a timing controller connected to the host processor; a gate driver connected between the timing controller and an active matrix display panel; and a source driver connected between the timing controller and the active matrix display panel.

The host processor may be configured to generate a plurality of input display data and a synchronization signal. The timing controller may be configured to receive the input display data and synchronization signal and generate a row selection signal to the gate driver for selecting the rows of pixels and generate a plurality of output display data, a shift signal and a latch signal to the source driver for programming luminance of each pixel.

Figure 2:
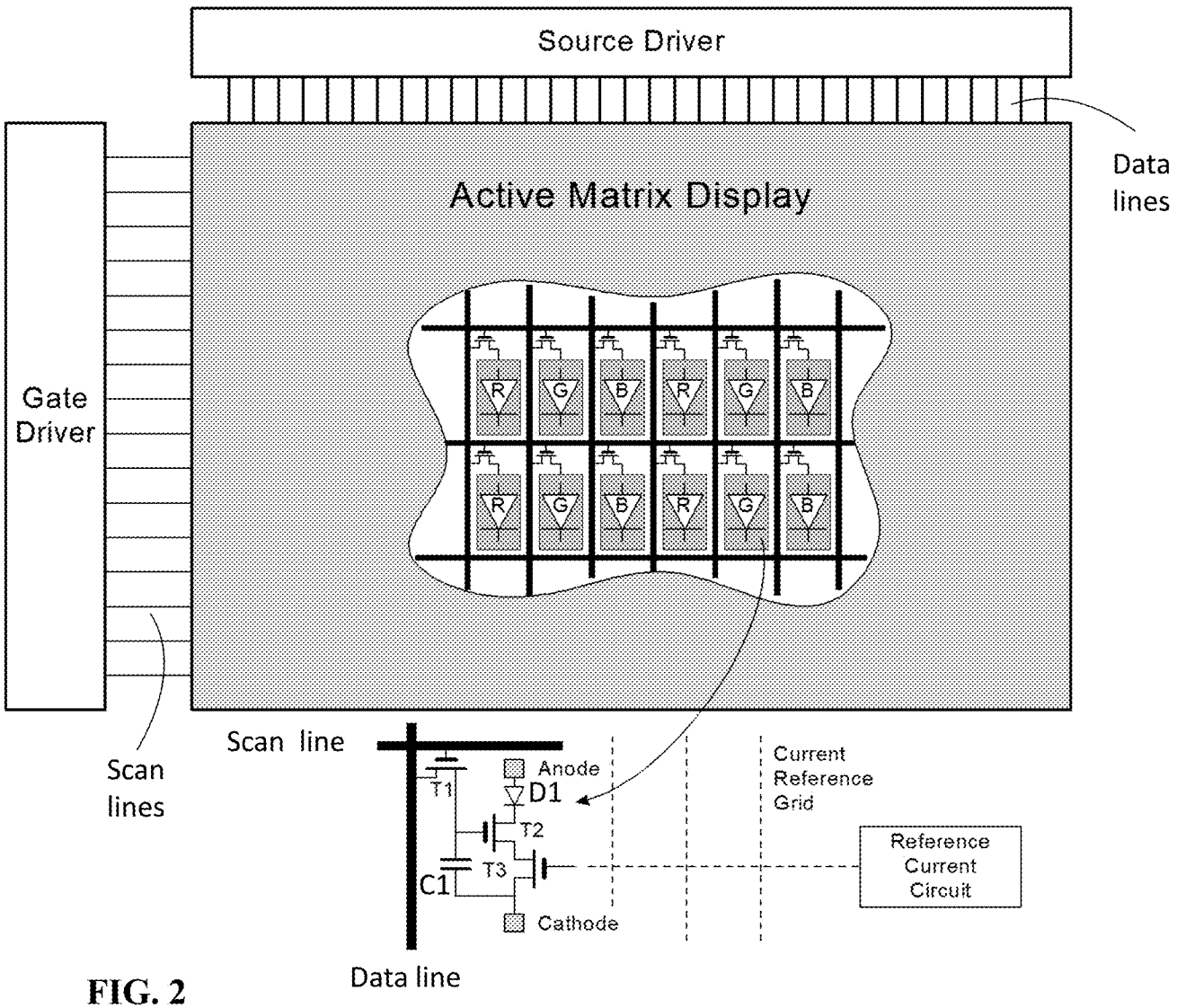
FIG. 2 depicts an active driving circuit in each pixel of the active matrix display device according to an embodiment of the present invention.

Referring to FIG. 2. The active matrix display panel may include a two-dimensional array of pixels. Each pixel has an active driving circuit including transistors T1, T2 and T3, and capacitor C1 and an electroluminescent element, such as LED D1. LED D1 has a positive terminal connected to an anode of the pixel. The capacitor C1 has a first terminal connected to a cathode of the pixel. The transistor T1 has a gate terminal connected to a scan line, a drain terminal connected to a data line and source terminal connected to a second terminal of the capacitor C1. The transistor T2 has a gate terminal connected to the second terminal of the capacitor C1, a drain terminal connected to a negative terminal of the LED D1. The transistor T3 has a gate terminal connected to a current reference grid, a drain terminal connected to a source terminal of transistor T2 and a source terminal connected to the cathode.

Transistor T1 controls gate ON/OFF. Transistor T2 controls the ON/OFF of an electroluminescent element such as a LED. Transistor T3 controls the current amplitude. The gate driver selects through the scan lines the row of pixels to be turn on. The source driver programs the luminance of each pixel through the data lines. All pixels on the display take reference voltage from the current reference grid.

Figure 3:
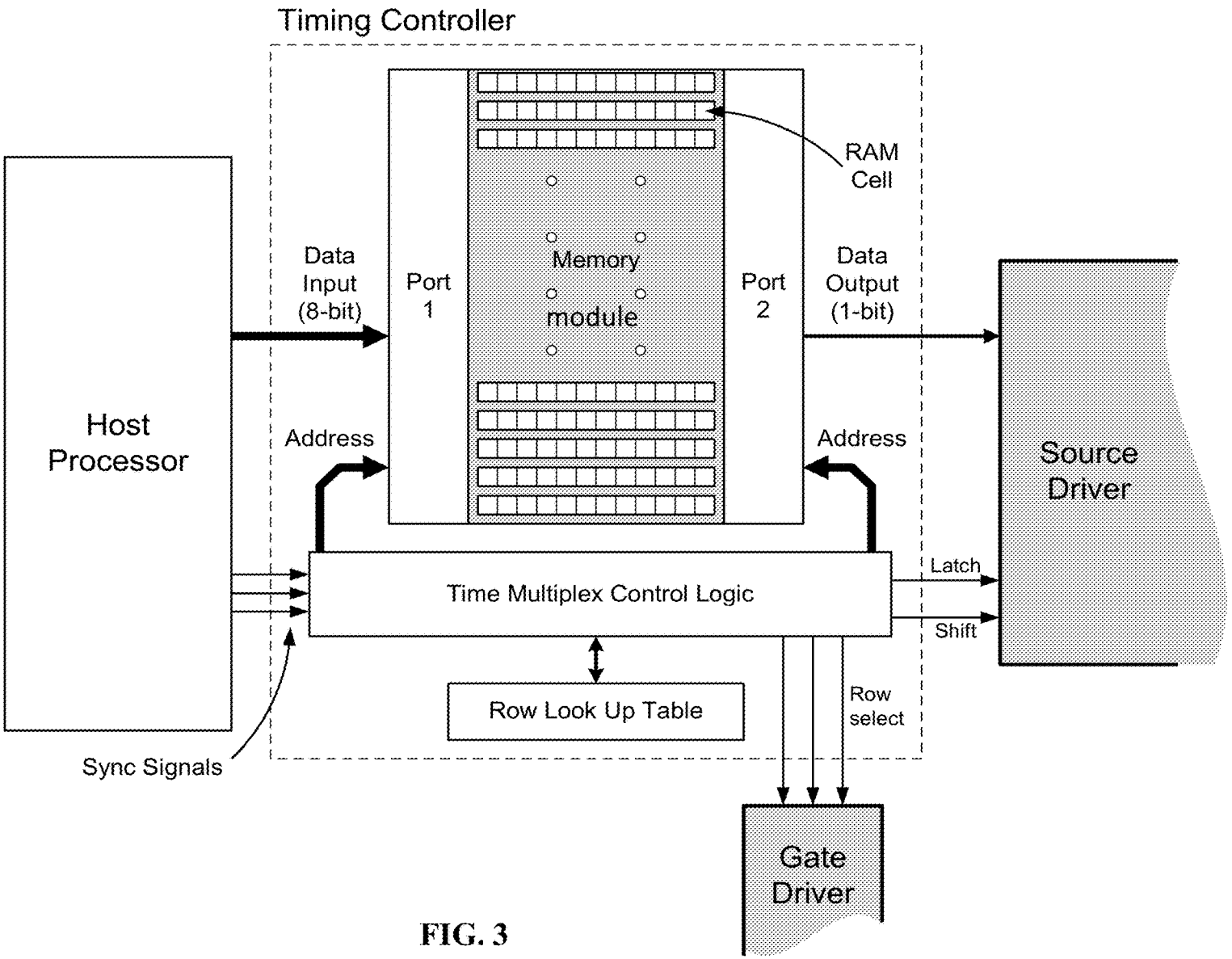
FIG. 3 depicts more detailed system block diagram of a timing controller according to an embodiment of the present invention.

Referring to FIG. 3, the timing controller may comprise a memory module and a time multiplex control logic. The memory module is configured to receive input display data in parallel and dispatch output display data in series. The time multiplex control logic is configured to receive the synchronization signal and control the read and write of the memory module. The time multiplex control logic is further configured to generate the row selection signal to the gate driver, and generate the shift signal and the latch signal to the source driver.

Referring to FIG. 3. The memory module may comprise an array of random access memory (RAM) cells arranged such that the number of RAM columns is at least equal to the number of data lines in the display panel and the number of RAM rows is at least equal to the product of the number of scan lines and the number of bits of image data to be displayed. Each RAM cell is configured to store a value "1" or "0" of a corresponding bit in an image data to be displayed by a corresponding pixel in the display panel.

To represent an image data with n bits, n successive RAM rows of memory will be accessed and RAM cells in each row of the n successive RAM rows are configured to store value of bits in the input data respectively. For example, to represent image data with 8 bits, RAM cells in the first row of the 8 successive rows store values of b0, RAM cells in the second row of the 8 successive rows store values of b1, RAM cells in the third row of the 8 successive rows store values of b2 and so on.

Figure 4:
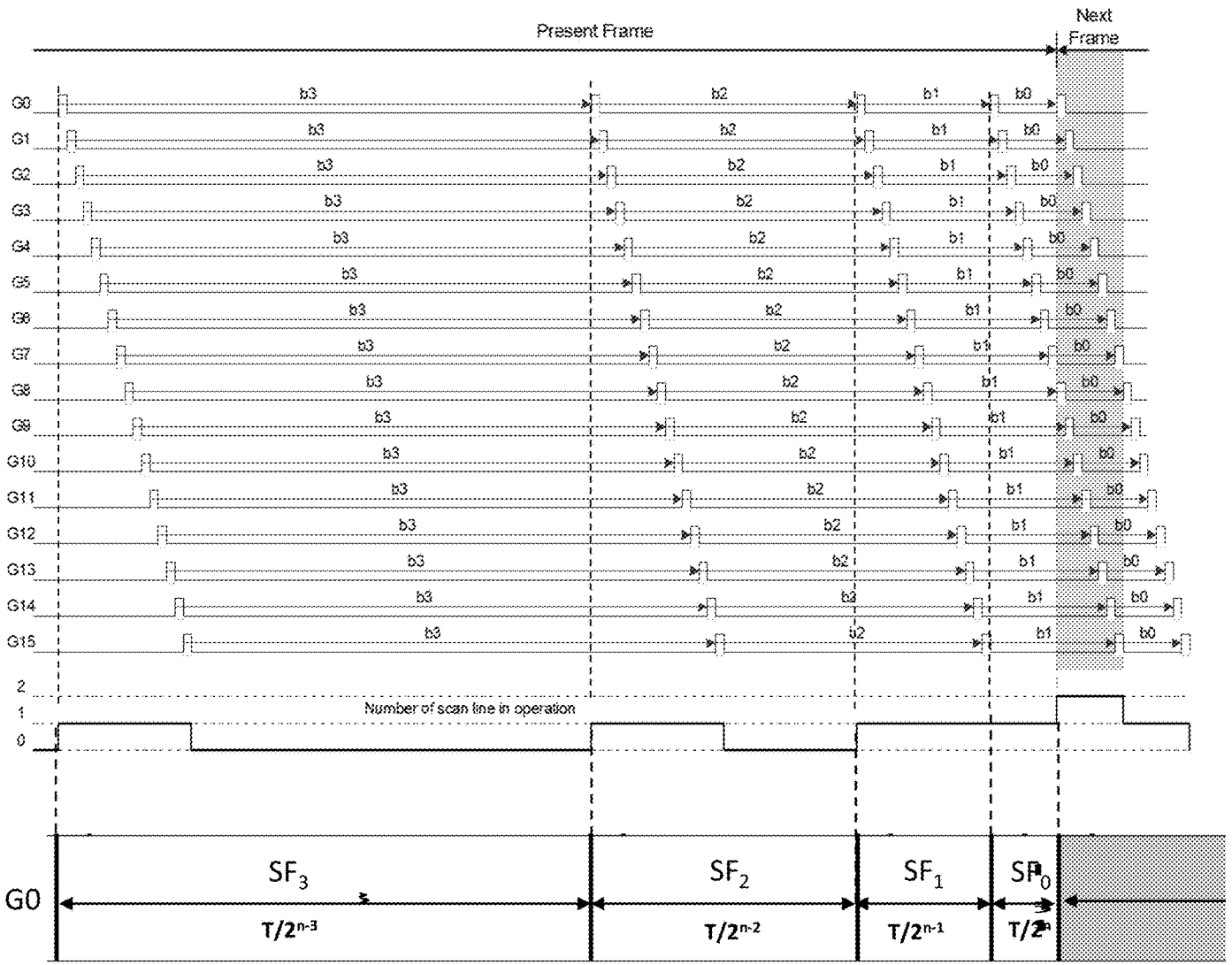
FIG. 4 show scanning pulse waveforms associated with a conventional method for driving an active matrix display.

FIG. 4 show scanning pulse waveforms associated with a conventional method for driving an active matrix display. For simplicity, only 16 scan lines (G0, G1, . . . G15) are illustrated. In order to represent a n-bit digital image data, each frame is divided into n sub-frames $SF_i$, each corresponding to a bit $b_i$ in the digital image data, where i=0, 1, . . . , n−1. The subframes may have different durations which are weighted according to positions of bits to be represented respectively and under a rule that the more significant bit the subframe represents the longer the subframe duration is.

In some embodiments, duration in each subframe $SF_i$ may be weighted by a weighting factor $$\left(\frac{2^i}{2^n}\right)$$

and the durations $t_i$ of each the subframes $SF_i$ may be given by $$t_i = \left(\frac{2^i}{2^n}\right)T,$$

where T is the frame period. Accordingly, the least significant bit $b_0$ of the image data may be represented by subframe $SF_0$ having a duration of $$\frac{1}{2^n}T,$$

while the most significant bit $b_{n-1}$ may be represented by the subframe $SF_{n-1}$ having a duration of $$\frac{1}{2}T.$$

In each sub-frame, each row of pixels (or scan lines) is scanned for a scan time. Pixels of the scanned row are then controlled to emits at a fixed luminance (turned ON) or zero luminance (turned OFF) to represent a logical value of "1"

or "0" respectively and hold the state over a hold time within the subframe duration. As such, a gray level scale of $2^n$ levels can be achieved by means of aggregation of the hold times over which the pixel is turned ON within each frame. Assuming the image data has 6 bits, if a pixel at ith row and jth column, denoted as $P_{ij}$, has its b3, b2, b1 and b0 being equal to '1', the pixel $P_{ij}$ may have a relative brightness equals to 15.

The timing controller may further include an internal scan counter (not shown) configured to increment number of clock cycles provided in the synchronization signal and generate scan counts for measuring and controlling the subframe durations.

In order to utilize the scan sequence in a more flexible way, the n-bit image data may be defined to have n1 number of greater significant bits and n2 number of lesser significant bits, where n1+n2=n; and the rows of pixels are selected non-sequentially in the subframes corresponding to the n2 number of lesser significant bits such that there is no more than one row of pixels being selected in each subframe.

Figures 12A, 12B:
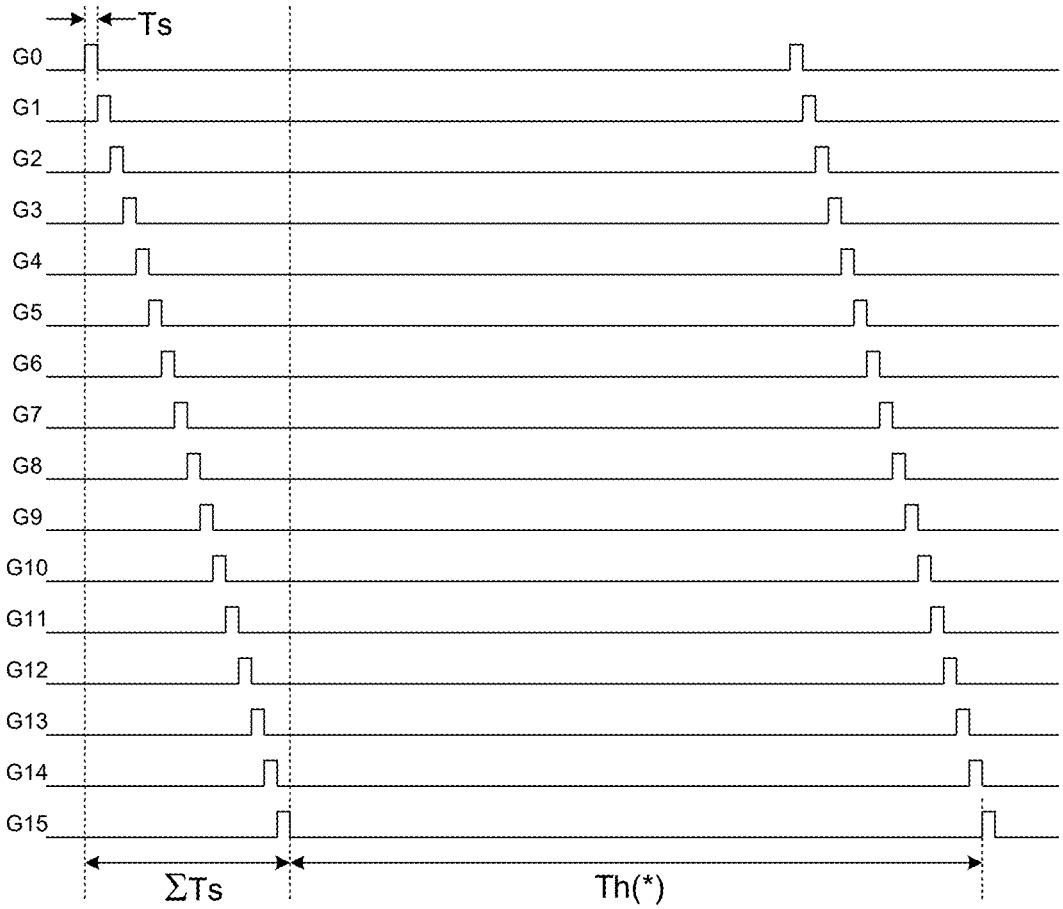
FIG. 12A illustrates shows a typical subframe according to an embodiment of the present invention.
FIG. 12B shows a summary table of minimum required numbers of lesser significant bits, n2_min, for different total scan times.

FIG. 12A shows a typical subframe according to an embodiment of the present invention. Each row of pixels is scanned for a scan time, Ts. The total scan time to scan all rows of a display is marked as ΣTs. The hold time for a particular bit bi is denoted as Th(i), where i=0, 1, 2, . . . n−1. As such, the hold time for b0 is marked as Th(0) and the hold time for b1 is marked as Th(1) and the hold time for b2 is marked as Th(2) and so on. In this embodiment, Th(1)=2*Th(0) and Th(2)=4*Th(0). The hold time of an upper bit is twice the hold time of its direct successive lower bit. That is Th(i)=2*Th(i−1).

For higher scanning rate, a shorter total scan time is allowed and the rows of pixels should be selected non-sequentially in subframes corresponding to more lesser significant bits.

The maximum total scan time that can be support by b0, b1, b2:

$$= \frac{Th(0)+Th(1)+Th(2)}{1.7\times 3} = \frac{Th(0)+2\times Th(0)+4\times Th(0)}{1.7\times 3}$$
$$= 1.37\times Th(0)$$

The maximum total scan time that can be support by b0, b1, b2, b3:

$$= \frac{Th(0)+Th(1)+Th(2)+Th(3)}{1.7\times 4}$$
$$= \frac{Th(0)+2\times Th(0)+4\times Th(0)+8\times Th(0)}{1.7\times 4}$$
$$= 2.21\times Th(0)$$

The maximum total scan time that can be support by b0, b1, b2, b3, b4:

$$= \frac{Th(0)+Th(1)+Th(2)+Th(3)+Th(4)}{1.7\times 5}$$
$$= \frac{Th(0)+2\times Th(0)+4\times Th(0)+8\times Th(0)+16Th(0)}{1.7\times 5}$$
$$= 3.64\times Th(0)$$

The number 1.7 used in the above calculation is a magic number which is needed to provide enough margin to maneuver the swapping of subframes within each group.

FIG. 12B shows a summary table of minimum required numbers of lesser significant bits, n2 min, for different total scan times. When ΣTs≤1.3Th(0), the minimum required number of lesser significant bits is 3; When ΣTs≤2.2 Th(0), the minimum required number of lesser significant bits is 4; When ΣTs≤3.6 Th(0), the minimum required number of lesser significant bits is 5.

Therefore, if ΣTs is equal to 1.5*Th(0), then the lesser significant bits must include b0, b1, b2 and b3. If ΣTs is equal to 2.5*Th(0), then the lesser significant bits must include b0, b1, b2, b3 and b4. Of course, if Ts equals 1.5*Th(0), the lesser significant bits can include more than the required bits, such as b0, b1, b2, b3 and b4, but this would make the hardware design unnecessarily complicated.

In accordance with some embodiments of the present invention, the plurality of rows of pixels are grouped into k groups, where k is a natural number equal or greater than 2. Preferably, k may be a factor of n and the number of rows of pixels of each group may be equal to n/k.

Subframes corresponding to the n2 number of lesser significant bits for the rows of pixels of the same group are arranged in the same order; and subframes corresponding to the n2 number of lesser significant bits for the rows of pixels of different groups are arranged in different orders.

Figure 5:
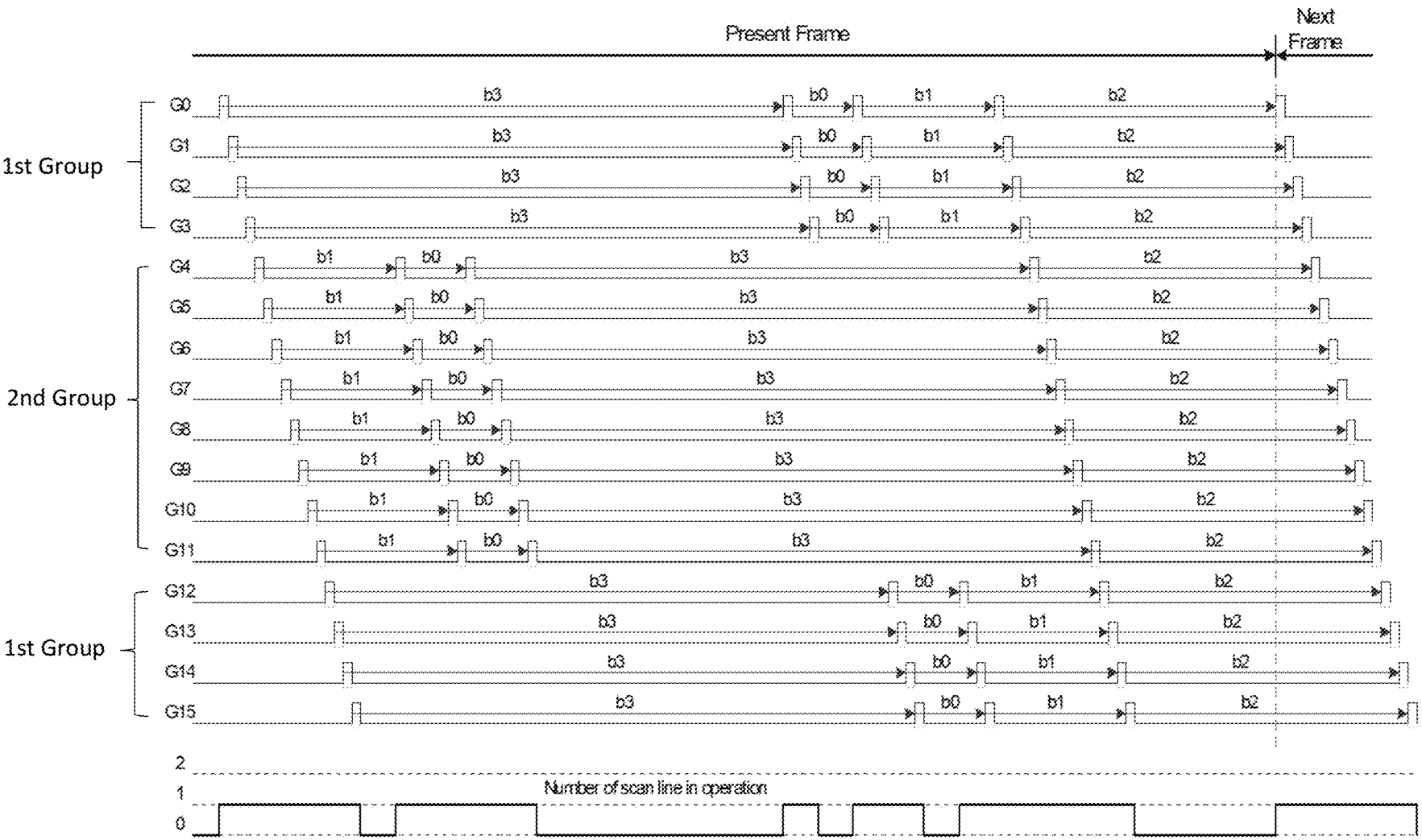
FIGS. 5-7 depicts how the subframes corresponding to the lesser significant bits are arranged according to various embodiments of the present invention.

FIG. 5 depicts scanning pulse waveforms associated with a method for driving an active matrix display according to an embodiment of the present invention. In this embodiment, the number of lesser significant bits, n2, is defined to be 4. The subframes corresponding to the 4 lesser significant bits b3, b2, b1 and b0 are SF3, SF2, SF1, and SF0 respectively.

Referring to FIG. 5. The 16 scan lines are grouped into 2 groups. For the first group (G0, G1, G2, G3, G12, G13, G14, G15), the sequence of subframes is arranged in the order of SF3-SF0-SF1-SF2. For the second group (G4, G5, G6, G7, G8, G9, G10, G11), the sequence of subframes is arranged in the order of SF1-SF0-SF3-SF2.

Figure 6:
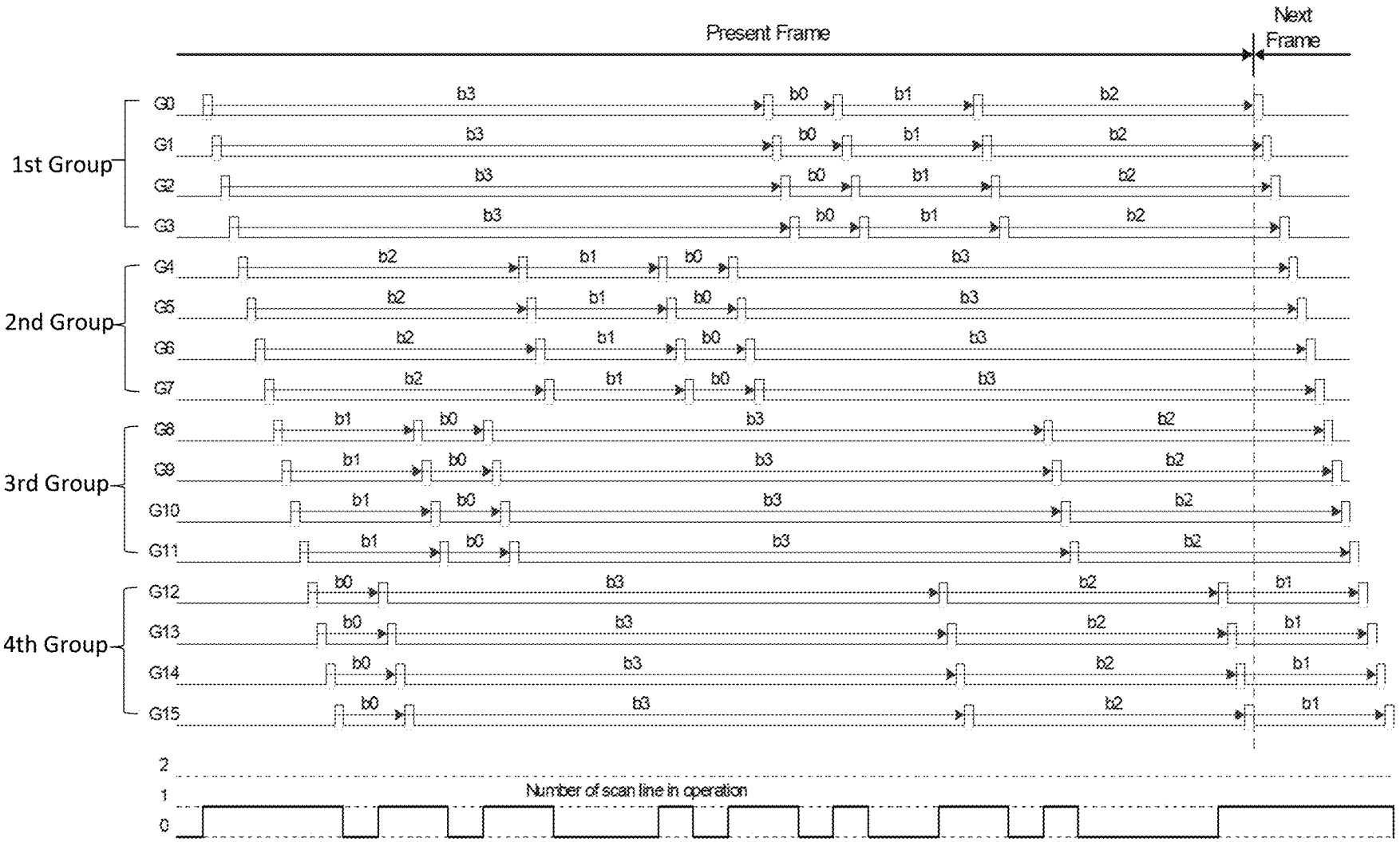

In accordance with some embodiments of the present invention, the plurality of rows of pixels may be consecutively grouped. FIG. 6 depicts scanning pulse waveforms associated with a method for driving an active matrix display wherein the rows of pixels are consecutively grouped. For simplicity, only 16 scan lines (G0, G1, G15) are illustrated. In this embodiment, the number of lesser significant bits, n2, is defined to be 4. The subframes corresponding to the 4 lesser significant bits b3, b2, b1 and b0 are SF3, SF2, SF1, and SF0 respectively.

Referring to FIG. 6. The 16 scan lines are consecutively grouped into 4 groups. For the first group (G0, G1, G2, G3), the sequence of subframes is arranged in the order of SF3-SF0-SF1-SF2. For the second group (G4, G5, G6, G7), the sequence of subframes is arranged in the order of SF2-SF1-SF0-SF3. For the third group (G8, G9, G10, G11), the sequence of subframes is arranged in the order of SF1-SF0-SF3-SF2. For the fourth group (G12, G13, G14, G15), the sequence of subframes is arranged in the order of SF0-SF3-SF2-SF1.

Figure 7:
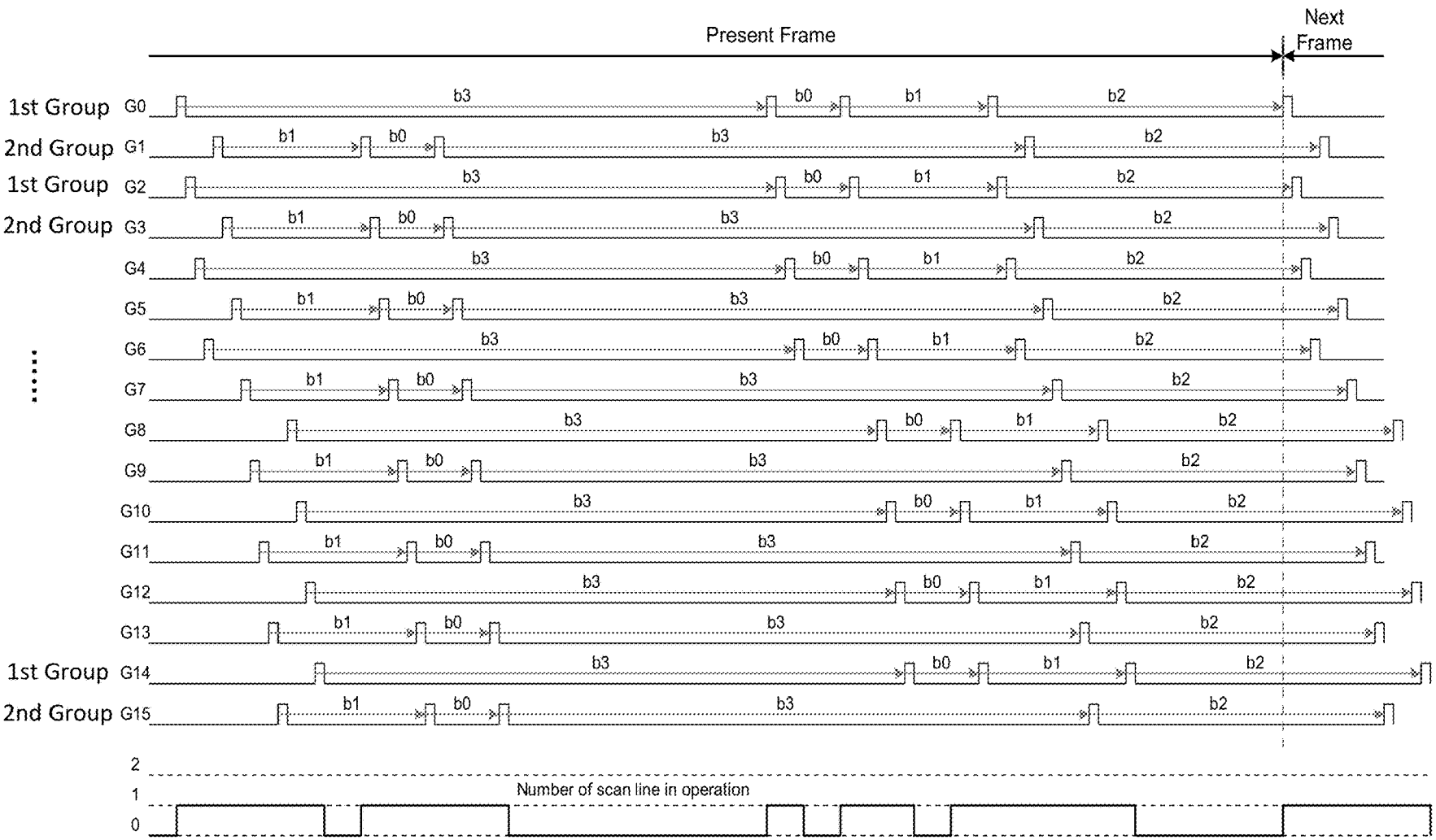

In accordance with some embodiments of the present invention, the plurality of rows of pixels may be alternately grouped. FIG. 7 depicts scanning pulse waveforms associated with a method for driving an active matrix display wherein the rows of pixels are alternately grouped. For simplicity, only 16 scan lines (G0, G1, G15) are illustrated. In this embodiment, the number of lesser significant bits, n2, is defined to be 4. The subframes corresponding to the 4 lesser significant bits b3, b2, b1 and b0 are SF3, SF2, SF1, and SF0 respectively.

Referring to FIG. 7. The 16 scan lines are alternately grouped into 2 groups. For the first group (G0, G2, . . . , G14), the sequence of subframes is arranged in the order of SF3-SF0-SF1-SF2. For the second group (G1, . . . , G15), the sequence of subframes is arranged in the order of SF1-SF0-SF3-SF2.

In accordance with various embodiments of the present invention, the sequence of scanning for the subframes corresponding to the n2 number of lesser significant bits may be prescribed and stored in a look-up table. FIG. 8 shows an exemplary look-up table according to the embodiment of FIG. 6. For illustration purpose, the look-up table are separated into Part 1, 2, 3. Based on the look-up table, at most one scan line is selected and one RAM row is deployed for driving the pixels in the selected row with the value of a corresponding bit for each scan count.

For example, at the $10^{th}$ scan count, the $10^{th}$ scan line is selected and RAM row 41 is deployed for driving the pixels in the $10^{th}$ row with the value of bit b1; at the $20^{th}$ scan count, the $12^{th}$ scan line is selected and RAM row 51 is deployed for driving the pixels in the $12^{th}$ row with the value of bit b3; at the $40^{th}$ scan count, no scan line is selected and no RAM is deployed; and at the $99^{th}$ scan count, the $11^{th}$ scan line is selected and RAM row 46 is deployed for driving the pixels in the $11^{th}$ row with the value of bit b2.

The size of the look-up table depends on a total number of scan counts (or time slots) required to complete the scanning for the subframes corresponding to the n2 number of lesser significant bits. The number of scan counts required for each subframe is proportional to the duration of the subframe. Therefore, for representing an image data, the numbers of time slots $N_i$ for representing a bit bi of an image data may be given by $N_i=2^iN_0$, where $N_0$ is the number of time slots in the subframe representing the least significant bit b0. Therefore, the total number of time slots required to complete the scanning for the subframes corresponding to the n2 number of lesser significant bits is equal to $N_0\Sigma_{i=0}^{i=n2-1}2^i$.

Referring back to the look-up table of FIG. 8, the number of time slots in the subframe representing the least significant bit b0 is set to be 8, therefore the total number of scan counts for scanning the subframes corresponding to the 4 lesser significant bits b3, b2, b1 and b0 is equal to $8*\Sigma_{i=0}^{i=3}2^i=8*(1+2+4+8)=200$ (from scan counts 0 to 119).

FIGS. 9A-9B, 10A-10B and 11 illustrate how the subframes corresponding to the n1 number of greater significant bits in the n-bit image data are arranged according to various embodiments of the present invention.

In some embodiments, the subframes corresponding to the n1 number of greater significant bits are arranged before the subframes corresponding to the n2 number of less significant bits.

Figure 9A:
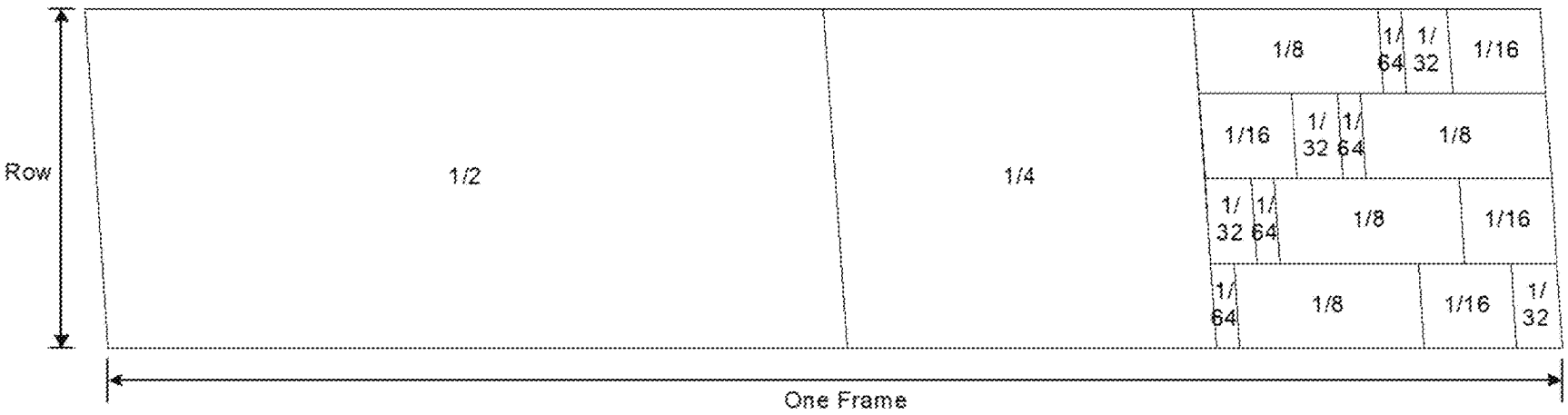
FIGS. 9A-9B, 10A-10B and 11 illustrates how the subframes corresponding to the greater significant bits are arranged according to various embodiments of the present invention.
Figure 9B:
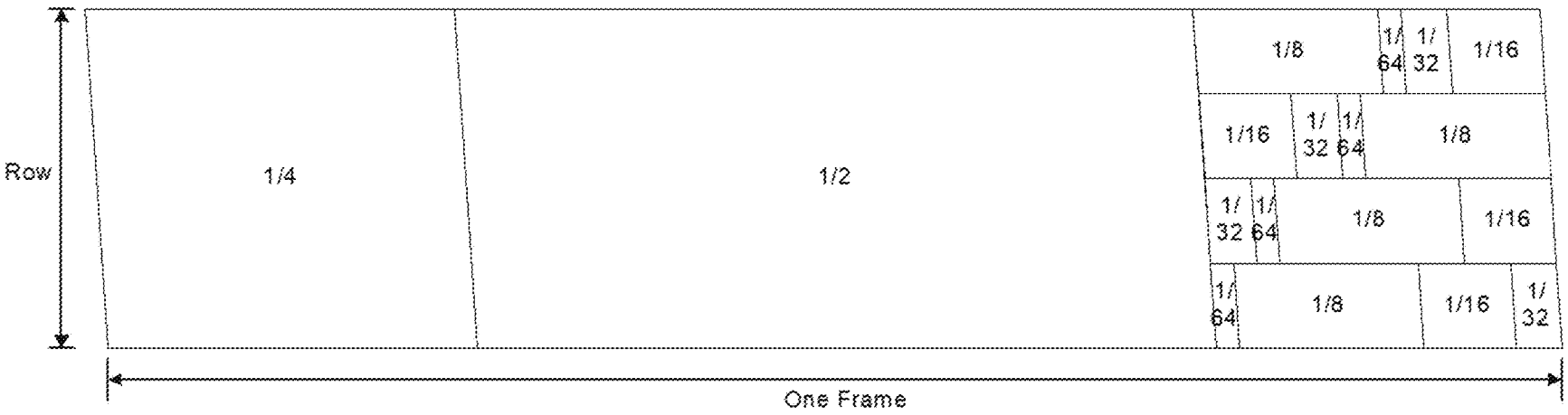

FIGS. 9A and 9B depict embodiments in which subframes corresponding to the greater significant bits are arranged before the subframes corresponding to the less significant bits. For simplicity, the n-bit image data is assumed to be a 6-digit image data and defined to have 2 greater significant bits and 4 lesser significant bits.

In one embodiment, the subframes corresponding to the n1 number of greater significant bits may be arranged in a descending order (with durations arranged from the longest to the shortest). As shown in FIG. 9A, the subframes SF5 and SF4 corresponding to the 2 greater significant bits b5 and b4 are arranged in the order of SF5-SF4 (with durations arranged from ½ to ¼).

In another embodiment, the subframes corresponding to the n1 number of greater significant bits may be arranged in an ascending order (with durations arranged from the shortest to the longest). As shown in FIG. 9B, the subframes SF5 and SF4 corresponding to the 2 greater significant bits b5 and b4 are arranged in the order of SF4-SF5 (with durations arranged from ¼ to ½).

Figure 10A:
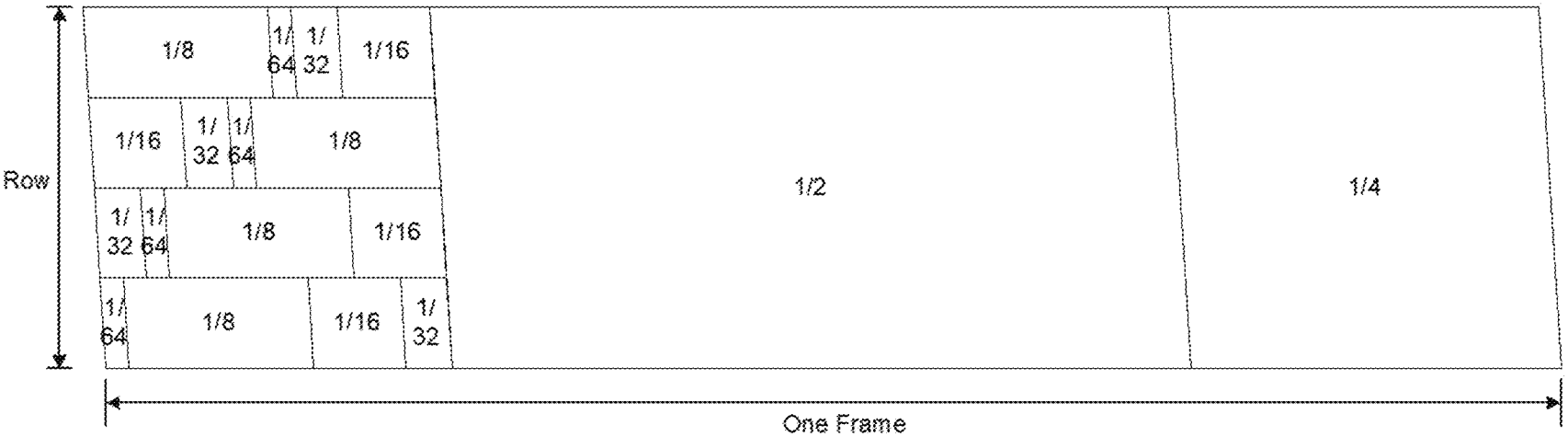
Figure 10B:
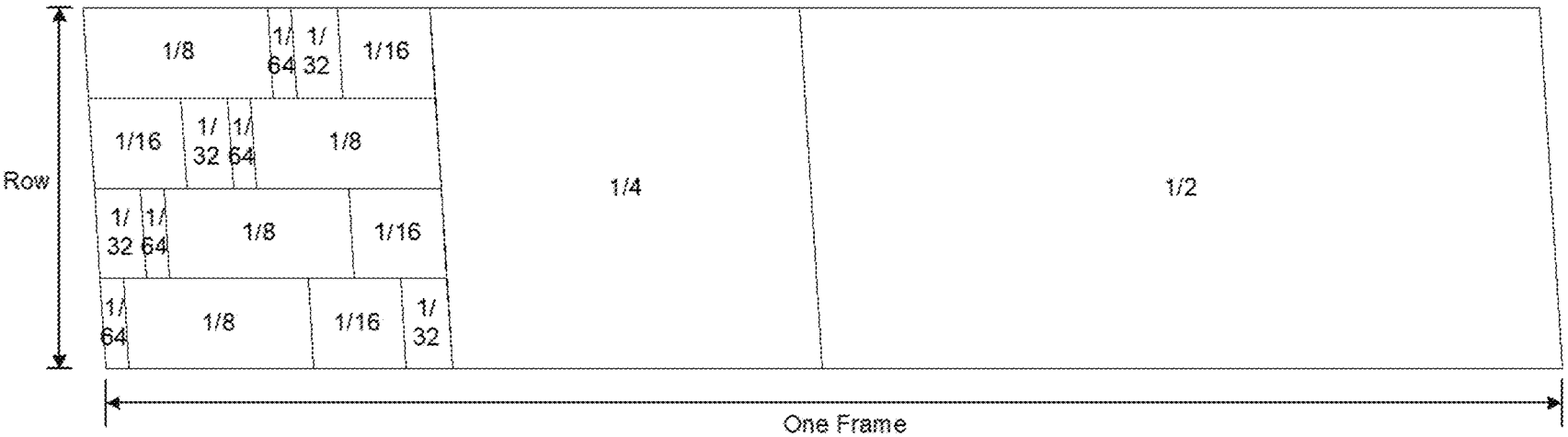

FIGS. 10A and 10B depict embodiments in which subframes corresponding to the greater significant bits are arranged after the subframes corresponding to the less significant bits. For simplicity, the n-bit image data is assumed to be a 6-digit image data and defined to have 2 greater significant bits and 4 lesser significant bits.

In one embodiment, the subframes corresponding to the n1 number of greater significant bits may be arranged in a descending order (with durations arranged from the longest to the shortest). As shown in FIG. 10A, the subframes SF5 and SF4 corresponding to the 2 greater significant bits b5 and b4 are arranged in the order of SF5-SF4 (with durations arranged from ½ to ¼).

In another embodiment, the subframes corresponding to the n1 number of greater significant bits may be arranged in an ascending order (with durations arranged from the shortest to the longest). As shown in FIG. 10B, the subframes SF5 and SF4 corresponding to the 2 greater significant bits b5 and b4 are arranged in the order of SF4-SF5 (with durations arranged from ¼ to ½).

Figure 11:
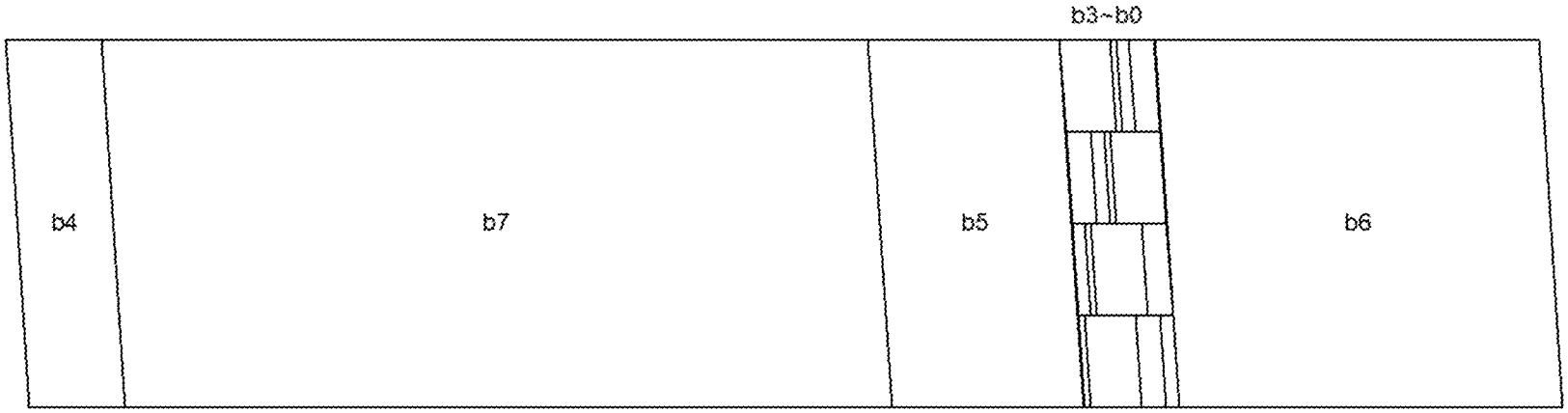

FIG. 11 depict embodiments in which the subframes corresponding to the n1 number of greater significant bits are grouped into a first group and a second group; the first group are arranged before the subframes corresponding to the n2 number of less significant bits; and the second group are arranged after the subframes corresponding to the n2 number of less significant bits. For simplicity, the n-bit image data is assumed to be an 8-digit image data and defined to have 4 greater significant bits and 4 lesser significant bits.

As shown in FIG. 11, the subframes SF7, SF5 and SF4 corresponding to the first group of 3 greater significant bits b7, b5 and b4 are arranged before the subframes corresponding to the 4 number of less significant bits b3-b0, and the subframes SF6 corresponding to the second group of 1 greater significant bit b6 is arranged after the subframes corresponding to the 4 number of less significant bits b3-b0.

It should be apparent to practitioner skilled in the art that the foregoing examples of digital driving methods are only for the purposes of illustration of working principle of the present invention. It is not intended to be exhaustive or to limit the invention to the precise forms disclosed.

The embodiments disclosed herein may be implemented using general purpose or specialized computing devices, computer processors, or electronic circuitries including but not limited to digital signal processors (DSP), application specific integrated circuits (ASIC), field programmable gate arrays (FPGA), and other programmable logic devices configured or programmed according to the teachings of the present disclosure. Computer instructions or software codes running in the general purpose or specialized computing devices, computer processors, or programmable logic devices can readily be prepared by practitioners skilled in the software or electronic art based on the teachings of the present disclosure.

In some embodiments, the present invention includes computer storage media having computer instructions or software codes stored therein which can be used to program computers or microprocessors to perform any of the processes of the present invention. The storage media can include, but are not limited to ROMs, RAMS, flash memory devices, or any type of media or devices suitable for storing instructions, codes, and/or data.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

The invention claimed is:

1. A method for driving an active matrix display panel comprising a matrix of pixels organized in Nr number of rows and Nc number of columns, each pixel being configured to display an n-bit image data in an image frame; the method comprising:

dividing the image frame for each pixel into n subframes, $SF_i$, each corresponds to a bit $b_i$ in the image data to be displayed by the pixel, where i=0, 1, . . . , n−1, and having a subframe duration being weighted according to a position of the corresponding bit $b_i$ in the image data;

dividing each subframe into a scan time and a hold time occurring after the scan time;

selecting each row of pixels for each subframe by applying a scanning signal to a scan line connected to the row of pixels over the scan time; and driving each pixel of the row selected in each subframe to emit a luminance by applying a data signal to a data line connected to the pixel and holding the luminance over the hold time; wherein the emitted luminance represents a logic value of a corresponding bit in the image data to be displayed by the pixel; and wherein:

the n-bit image data is defined to have n1 number of greater significant bits and n2 number of lesser significant bits, where n1+n2=n; and the rows of pixels are selected non-sequentially in the subframes corresponding to the n2 number of lesser significant bits such that there is no more than one row of pixel being selected in each subframe.

2. The method according to claim 1, wherein the plurality of rows of pixels are grouped into k groups, where k is a natural number equal or greater than 2;

subframes corresponding to the n2 number of lesser significant bits for the rows of pixels of the same group are arranged in the same order; and subframes corresponding to the n2 number of lesser significant bits for the rows of pixels of different groups are arranged in different orders.

3. The method according to claim 2, wherein k is a factor of n and the number of rows of pixels of each group is equal to n/k.

4. The method according to claim 2, wherein the plurality of rows of pixels are consecutively grouped.

5. The method according to claim 2, wherein the plurality of rows of pixels are alternately grouped.

6. The method according to claim 1, wherein the subframes corresponding to the n1 number of greater significant bits are arranged before the subframes corresponding to the n2 number of less significant bits.

7. The method according to claim 6, wherein the subframes corresponding to the n1 number of greater significant bits are arranged in a descending order.

8. The method according to claim 6, wherein the subframes corresponding to the n1 number of greater significant bits are arranged in an ascending order.

9. The method according to claim 1, wherein the subframes corresponding to the n1 number of greater significant bits are arranged after the subframes corresponding to the n2 number of less significant bits.

10. The method according to claim 9, wherein the subframes corresponding to the n1 number of greater significant bits are arranged in an ascending order.

11. The method according to claim 9, wherein the subframes corresponding to the n1 number of greater significant bits are arranged in a descending order.

12. The method according to claim 1, wherein the subframes corresponding to the n1 number of greater significant bits are grouped into a first group and a second group; and the first group are arranged before the subframes corresponding to the n2 number of less significant bits; and the second group are arranged after the subframes corresponding to the n2 number of less significant bits.

13. The method according to claim 12, wherein the first group of subframes corresponding to the n1 number of greater significant bits are arranged in an ascending order.

14. The method according to claim 12, wherein the first group of subframes corresponding to the n1 number of greater significant bits are arranged in a descending order.

15. The method according to claim 12, wherein the second group of subframes corresponding to the n1 number of greater significant bits are arranged in an ascending order.

16. The method according to claim 12, wherein the second group of subframes corresponding to the n1 number of greater significant bits are arranged in a descending order.

17. The method according to claim 1, wherein the rows of pixels are selected, in the subframes corresponding to the n2 number of lesser significant bits, based on a prescribed sequence stored in a look-up table.

18. The method according to claim 1, wherein duration in each subframe $SF_i$ is weighted by a weighting factor $$\left(\frac{2^i}{2^n}\right).$$

19. The method according to claim 18, wherein a subframe $SF_0$ corresponding to the least significant bit $b_0$ of the image data is configured to have a duration of $\frac{1}{2}^n T$, while a subframe $SF_{n-1}$ corresponding to a most significant bit $b_{n-1}$ of the image data is configured to have a duration of $\frac{1}{2}T$, where T is the frame period.

* * * * *